United States Patent [19]

Maliszewski et al.

[11] Patent Number: 4,605,174

[45] Date of Patent: Aug. 12, 1986

[54] VANE WHEEL ARRANGEMENT WITH NIHARD WEAR PLATES

[75] Inventors: Theodore V. Maliszewski, North Canton; David E. Kohler, Windsor, both of Conn.

[73] Assignee: Combustion Engineering, Inc., Windsor, Conn.

[21] Appl. No.: 627,157

[22] Filed: Jul. 2, 1984

Related U.S. Application Data

[62] Division of Ser. No. 447,916, Dec. 8, 1982.

[51] Int. Cl.[4] ..... B02C 15/00

[52] U.S. Cl. ..... 241/52; 241/119

[58] Field of Search ..... 241/117–122, 241/52, 53, 58; 416/224

[56] References Cited

U.S. PATENT DOCUMENTS

| | | | |
|---|---|---|---|
| 1,733,417 | 10/1929 | Loesche | 241/121 X |
| 2,389,844 | 11/1945 | Ebersole | 241/117 X |
| 2,653,755 | 9/1953 | Kruhmin | 416/224 X |
| 2,698,142 | 12/1954 | Crites et al. | 241/121 X |

*Primary Examiner*—Mark Rosenbaum
*Assistant Examiner*—Joseph M. Gorski
*Attorney, Agent, or Firm*—Arthur E. Fournier, Jr.

[57] ABSTRACT

A vane wheel arrangement (30) particularly suited for use in a bowl mill (10) of the type that is employed for purposes of effecting therewithin the pulverization of materials such as coal. The subject vane wheel arrangement (30) which is positioned within the bowl mill (10) so as to be located in the path of flow of the air that in flowing through the bowl mill (10) transports therewith the pulverized material, is operative to effect a primary classification of the pulverized material. Encompassed within the subject vane wheel arrangement (30) are vane means (36) supported on the rotatable grinding surface (14) of the bowl mill (10) for rotation therewith, and a converging/diverging orifice means (38) located in spaced relation to the rotatable grinding surface (14). Both the vane means (36) and the exposed surfaces of the converging/diverging orifice means (38) are formed of a material that is noted for its good abrasive resistant qualities.

5 Claims, 7 Drawing Figures

VANE WHEEL ARRANGEMENT WITH NIHARD WEAR PLATES

This is a Division, of application Ser. No. 447,916 filed Dec. 8, 1982.

BACKGROUND OF THE INVENTION

This invention relates to apparatus for pulverizing, i.e., grinding, material, and more specifically to a vane wheel arrangement that is particularly suited for embodiment in a bowl mill wherein the vane wheel arrangement is operative to effect a primary classification of the pulverized material.

It has long been known in the prior art to provide apparatus that is suitable for employment for purposes of effecting the grinding, i.e., pulverization, of materials. More specifically, the prior art is replete with examples of various types of apparatus that had been used heretofore to effect the grinding of a multiplicity of different kinds of materials. In this regard, in many instances discernible differences of a structural nature can be found to exist between individual ones of the aforesaid apparatus. The existence of such differences is in turn attributable for the most part of the diverse functional requirements that are associated with the individual applications in which such apparatus are designed to be employed. For instance, in the selection of the particular type of apparatus that is to be utilized for a specific application one of the principal factors to which consideration must be given is that of the nature of the material that is to be ground in the apparatus.

Coal is one such material wherein there exists a need to grind the material in order to render it suitable for use in certain applications. Furthermore, fossil fuel fired power generation systems represent one such application in which it is desired to employ coal, as the source of fuel therefor, and wherein a requirement exists to grind, i.e., pulverize, the coal in order to render it suitable for use for this purpose. To this end, coal has long been recognized as being one of this nation's most abundant sources of fuel. At one time earlier in this century, much of the nation's energy needs were being met thorugh the use of coal. Then, in the degree to which coal was being employed to generate power a decline set in. Much of this decline stemmed from the increased usage of oil and gas as sources of fuel. More recently, the power being generated from the burning of oil and gas has been supplemented by the use of nuclear fuel for power producing purposes. However, with the advent of the oil embargo in the last decade, which was accompanied by a sharp increase in the price of oil and the existence of restricted oil supplies, and the increased concern, which has since been expressed over the rate at which the world's known oil reserves are being depleted, coal has begun to regain some of the favor, which it once had as a source of fuel to meet the nation's energy needs. To some extent, this has been evidenced in a number of orders, which have been placed in recenlty passed years, for power generation systems that are to be coal-fired as well as the extent to which increased interest has been shown in effecting the conversion of existing oil and gas fired power generation systems to coal fired systems.

For purposes of the discussion that follows, the coal fired systems referred to above are considered to consist of essentially the following major operating components: a coal feeder, apparatus for pulverizing the coal, a distribution system for distributing the coal after the pulverization thereof, a furnace in which the coal is to be burned, and the requisite controls for effecting the proper operation of the coal fired power generation system. Of particular interest herein is that portion of the coal fired system, which has been identified above as the apparatus for pulverizing the coal. Coal pulverizing apparatus are not new. They have been know to exist in the prior art for more than half a century. Furthermore, many improvements in the construction and/or mode of operation of coal pulverizing apparatus have been made during this period.

There are a number of features that it is advantageous for any coal pulverizing apparatus to possess, but particularly those which are designed for employment in a coal fired power generation system. Reference is had here to features such as reliability, low power consumption, minimum maintenance and wide range of capacity. In addition, such apparatus advantageously should also be characterized by quiet operation, integrated lubrication systems, convenient adjustment and control of coal flow and fineness, and the ability to handle the high temperature air that is required for high moisture coal.

One particular type of coal pulverizing apparatus, which is to be found in the prior art, that is advantageously characterized by the embodiment therein of the above recited features is an apparatus, most commonly referred to in the industry by the name bowl mill. The latter apparatus obtains its name by virtue of the fact that the pulverization, i.e., grinding, of the coal which takes place therein is effected on a grinding surface that in configuration bears a resemblence to a bowl. Reference may be had by way of exemplification to U.S. Pat. No. 3,465,971, which issued Sept. 9, 1969 to J. F. Dalenberg et al., and/or U.S. Pat. No. 4,002,299, which issued Jan. 11, 1977 to C. J. Skalka, both of the latter patents being assigned to the same assignee as the instant application, for a teaching of the nature of the construction and the mode of operation of a prior art form of bowl mill that is suitable for use in a coal fired power generation system to effectuate the pulverization of the coal that is to be burned as fuel therein. As taught by the aforereferenced patents, a bowl mill essentially consists of a body portion in which a grinding table is mounted for rotation, a plurality of grinding rollers that coact with the grinding table to effect the grinding of coal interposed therebetween, coal supply means for feeding to the interior of the bowl mill the coal that is to be pulverized, and air supply means for supplying to the interior of the bowl mill the air required in the operation of the latter. In accordance with the mode of operation of such a bowl mill, the coal, which enters the bowl mill, is pulverized by virtue of the coaction of the grinding rollers with the grinding table. After being pulverized, the coal particles are thrown outwardly by centrifugal force whereby the particles are fed into a stream of air that is entering the bowl mill. The stream of air, which now contains pulverized coal particles, flows through a tortuous path that is established in part by the positioning within the bowl mill of a suitably supported deflector means. As the stream of air and coal particles flows along the aforementioned tortuous path, the sharp turns contained therein effects the separation of the coarse coal particles from the air stream. These coarse coal particles are then suitably returned to the grinding table for further pulverization, while the fine coal particles are carried through the bowl mill in the air stream, and exit therefrom along with the air.

In a conventional coal fired power generation system, a multiplicity of bowl mills of the type shown in the aforereferenced patents would commonly be employed for purposes of satisfying the requirements of the system for pulverized coal. By way of example, the capacity of each of the individual bowl mills might be on the order of 100 tons per hour of coal.

Although bowl mills constructed in accordance with the teachings of the aforereferenced patents have under actual operating conditions provided adequate performance to date, a need has nevertheless been evidenced for improvements to be made therein. More specifically, prolonged operation of this type of bowl mill has revealed the existence of several conditions of an undesirable nature that can arise during the use thereof. One of these is related to the need for and the manner in which a primary classification is had within the bowl mill of the material that is being pulverized therewithin. As employed herein the term primary classification is intended to refer to the separation of pulverized material from the air in which such material is entrained. In particular, reference is had here to that separation of pulverized material which occurs as a consequence of causing the air within which the pulverized material is entrained to follow a tortuous path through the bowl mill whereby in the course of changing directions of flow the larger of the particles of the pulverized material lose their momentum and are made to return to the surface of the grinding table whereat they are subjected to further pulverization.

In accordance with the teachings of the prior art, it has been known to employ a separator body liner design in a bowl mill for purposes of accomplishing the aforedescribed primary classification of pulverized material therewithin. By way of exemplification, such a bowl mill comprises the subject matter of U.S. Pat. No. 4,234,132 which issued on Nov. 18, 1980 to one of the two co-inventors of the present application and which is assigned to the same assignee as the present application. Although a bowl mill equipped with such a separator body liner design has proven to be adequate in terms of accomplishing the subject primary classification of the pulverized materials in a bowl mill disadvantages nevertheless are associated with the employment thereof. Namely, the air deflector means of such a bowl mill is so located therewithin for purposes of accomplishing the aforesaid primary classification of pulverized materials as to be positioned in overhanging relation to the grinding table of the bowl mill. As a consequence, access to the internal workings of a bowl mill equipped with such air deflector means is limited thereby by the positioning thereof. In addition, damage can be had thereto when incidents involving tramp iron occur. Finally, it would be desirable to achieve a better wear distribution pattern insofar as concerns those members mounted within the bowl mill which are designed to be used to direct the flow of air through the bowl mill. A need has thus been evidenced for a new and improved means suitable for employment in a bowl mill which would be operative when so positioned therewithin to effect the primary classification of material being pulverized within the bowl mill.

It is, therefore, an object of the present invention to provide a new and improved primary classifier means that is suitably constructed so as to be employable in a bowl mill.

It is another object of the present invention to provide such a primary classifier means for bowl mills which does not inhibit access from being had to the internal workings of the bowl mill.

It is still another object of the present invention to provide such a primary classifier means for bowl mills which includes vane means suitably supported on the circumference of the rotatable grinding surface of the bowl mill and operative to establish a direction of flow to the air that passes through the interior of the bowl mill.

A further object of the present invention is to provide such a primary classifier means for bowl mills which also includes a converging/diverging orifice means mounted in spaced relation to the rotatable grinding surface of the bowl mill and operative to further establish a direction of flow to the air that passes through the interior of the bowl mill.

A still further object of the present invention is to provide such a primary classifier means for bowl mills having vane means and converging/diverging orifice means that function in conjunction with one another to cause the larger of the particles of pulverized material which are entrained in the stream of air that flows through the bowl mill to be separated from the air stream and to be returned to the rotatable grinding surface for additional pulverization.

Yet another object of the present invention is to provide such a primary classifier means for bowl mills wherein the wear surfaces of the vane means and the converging/diverging orifice means are formed of a highly abrasive resistant material.

Yet still another object of the present invention is to provide such a primary classifier means for bowl mills which is suitable for employment in newly constructed bowl mills as well as being equally suitable for employment in retrofit applications.

SUMMARY OF THE INVENTION

In accordance with the present invention there is provided a primary classifier means that is particularly suited for employment in a bowl mill of the type that is operative for purposes of effecting the pulverization therewithin of a material such as coal. The subject primary classifier means includes vane means supported on the periphery of the rotatable grinding table of the bowl mill. The vane means is operative to cause the air flowing in surrounding relation to the rotatable grinding table to change direction and flow counterclockwise to the direction of rotation of the grinding table thereby causing the pulverized material that is entrained in the aforesaid air to be carried in a direction reverse to the direction of rotation of the grinding table. This in turn has the effect of causing the larger of the particles of pulverized material to lose their momentum whereby these larger particles are separated from the air stream and are returned to the surface of the rotating grinding table. The subject primary classifier means further includes a converging/diverging orifice means that is mounted within the bowl mill in spaced relation to the surface of the rotatable grinding table. The converging/diverging orifice means is operative to cause the air stream which has entrained therein pulverized material to be directed toward the center of the bowl mill. This change in direction of the air flow is effective to cause the larger, i.e., heavier, particles of pulverized material to lose their momentum whereby they separate out of the air stream and are returned to the grinding table for additional pulverization. Lastly, the wear surfaces of both the vane means and the converging/diverging orifice means are preferably made from a highly abrasive resistant material such as nihard.

DESCRIPTION OF A PREFERRED EMBODIMENT

Figure 1:
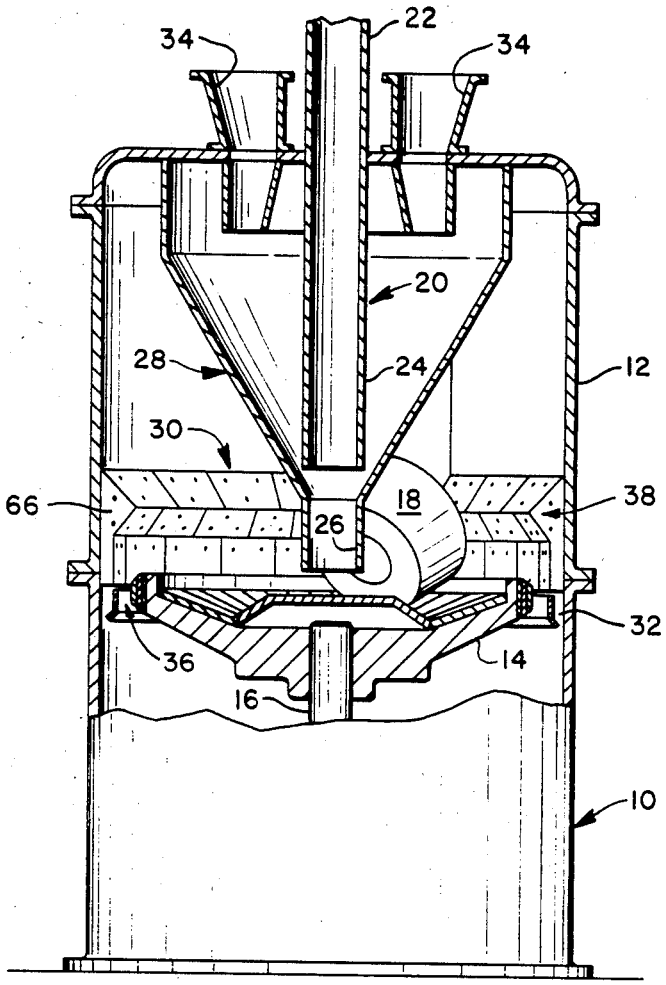
FIG. 1 is a side elevational view partially in section of a pulverizer bowl mill embodying a primary classifier means constructed in accordance with the present invention.

Referring now to the drawing, and more particularly to FIG. 1 thereof, there is depicted therein a pulverizing bowl mill, generally designated by reference numeral 10, constructed in accordance with the present invention. Inasmuch as the nature of the construction and the mode of operation of pulverizing bowl mills per se are known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of the pulverizing bowl mill 10 embodying improved primary classifier means in accordance with the present invention to merely present herein a description of the nature of the construction and the mode of operation of the components of the pulverizing bowl mill 10 with which the aforesaid primary classifier means cooperates. For a more detailed description of the nature of the constructin and the mode of operation of the components of the pulverizing bowl mill 10 which are not described in depth herein one may have reference to the prior art, e.g., U.S. Pat. No. 3,465,971, which issued Sept. 9, 1969 to J. F. Dalenberg et al., and/or U.S. Pat. No. 4,002,299, which issued Jan. 11, 1977 to C. J. Skalka.

Referring further to FIG. 1 of the drawing, the pulverizing bowl mill 10 as illustrated therein includes a substantially closed separator body 12. A grinding table 14 is mounted on a shaft 16, which in turn is operatively connected to a suitable drive mechanism (not shown) so as to be capable of being rotatably driven thereby. With the aforesaid components arranged within the separator body 12 in the manner depicted in FIG. 1 of the drawing, the grinding table 14 is designed to be driven in a clockwise direction.

Continuing with a description of the pulverizing bowl mill 10, a plurality of grinding rolls 18, preferably three in number in accord with conventional practice, are suitably supported within the interior of the separator body 12 so as to be equidistantly spaced one from another around the circumference of the separator body 12. In the interest of maintaining clarity of illustration in the drawing, only one such grinding roll 18 has been shown in FIG. 1. With further regard to the grinding rolls 18, each of the latter as best understood with reference to FIG. 1 of the drawing is preferably supported on a shaft (not shown), which in turn is cooperatively associated with some form of biasing means (not shown). By way of exemplification, the latter biasing means (not shown) may take the form of spring means such as that which is illustrated and described in U.S. Pat. No. 4,234,132. However, the biasing means (not shown) could equally well take the form of hydraulic mean. In any event whatever form the biasing means (not shown) takes, it is intended to be operative to urge the shaft (not shown) and thereby the grinding roll 18 cooperatively associated therewith towards the surface of the grinding table 14. Commonly, the biasing means (not shown) is provided with some form of adjustment means (not shown) through the operation of which adjustments can be made in the spacing that exists between the grinding roll 18 and the surface of the grinding table 14 on which the pulverization of the material, e.g., coal, occurs.

The material, e.g., coal, that is to be pulverized in the bowl mill 10 is fed thereto by means of any suitable conventional form of feed means. By way of exemplification in this regard, one such feed means that may be employed for this purpose is a belt feeder means (not shown). Upon being discharged from the feed means (not shown) the coal enters the bowl mill 10 by means of a coal supply means, generally designated by reference numeral 20, with which the separator body 12 is suitably provided. In accordance with the embodiment of the pulverizing bowl mill 10 illustrated in FIG. 1, the coal supply means 20 includes a suitably dimensioned duct 22 having one end thereof which extends outwardly of the separator body 12 and preferably terminates in a funnel-like member (not shown). The latter member (not shown) is suitably shaped so as to facilitate the collection of the coal particles entering the bowl mill 10, and the guiding thereafter of these coal particles into the duct 22. The other end 24 of the duct 22 of the coal supply means 20 is operative to effect the discharge of coal onto the surface of the grinding table 14. To this end, as shown in FIG. 1 of the drawing, the duct end 24 preferably is suitably supported within the separator body 12 through the use of any suitable form of conventional support means not shown) such that the duct end 24 is coaxially aligned with the shaft 16 that supports the grinding table 14 for rotation, and is located in spaced relation to a suitable outlet 26 provided in the classifier, generally designated by reference numeral 28, through which the coal flows in the course of being fed onto the surface of the grinding table 14.

In accord with the mode of operation of pulverizing bowl mills that embody the form of construction depicted in FIG. 1, a gas such as air is utilized to effect the conveyance of the coal from the grinding table 14 through the interior of the separator body 12 for discharge from the pulverizing bowl mill 10. The air that is used in this connection enters the separator body 12 through a suitable opening (not shown) found therein for this purpose. From the aforesaid opening (not shown) in the separator body 12 the air flows in surrounding relation from beneath the grinding table 14 to above the surface of the latter. More specifically, the air flows through the space, identified by the reference numeral 32 in FIG. 1, provided for this purpose between the inner wall surface of the separator body 12 and the circumference of the grinding table 14. The path of flow that the air follows thereafter will be described more fully hereinafter in connection with the description of the primary classifier means, generally designated by reference numeral 30 in FIG. 1, constructed in accord with the present invention with which the bowl mill 10 is provided.

Suffice it to say that as the air is made to flow through the interior of the bowl mill 10, the coal which is disposed on the surface of the grinding table 14 is being pulverized by the action of the grinding rolls 18. As the coal becomes pulverized, the particles that result therefrom are thrown outwardly by centrifugal force away from the center of the grinding table 14. Upon reaching the region of the circumference of the grinding table 14, the coal particles are picked up by the air flowing upwardly from beneath the grinding table 14 and are carried away therewith. Therafter, and as will be described more fully hereinafter, the stream of air with the coal particles entrained therein follows a tortuous path through the interior of the bowl mill 10. Moreover, in the course of following this tortuous path the larger of the coal particles are caused to be separated from the air stream in which they are entrained and are made to return to the surface of the grinding table 14 whereupon they undergo further pulverization. The lighter of the coal particles, on the other hand, continue to be carried along in the air stream. Ultimately, the combined stream of air and those coal particles that remain entrained therein flows to the classifier 28 to which reference has previously been had hereinbefore.

The classifier 28, in accord with conventional practice and in a manner which is well-known to those skilled in this art, operates to effect a further sorting of the coal particles that remain in the air stream. Namely, those particles of pulverized coal, which are of the desired particle size, pass through classifier 28 and along with the air are discharged therefrom and thereby from the bowl mill 10 through the outlets 34 with which the latter is provided for this purpose. On the other hand, those coal particles which in size are larger than desired, are returned to the surface of the grinding table 14 whereupon they undergo additional pulverization. Thereafter, these coal particles are subject to a repeat of the process described above. That is, the particles are thrown outwardly of the grinding table 14, are picked up by the air exiting from beneath the grinding table 14, are carried along with the air through the yet to be described tortuous path that is provided therefor through the interior of the bowl mill 10, as the air stream follows the aforesaid tortuous path the heavier particles drop back onto the grinding table 14, the lighter particles though continue to be carried along with the air to the classifier 28, those particles which are of the proper size pass through the classifier 28 and exit from the bowl mill 10 through the outlets 34.

Turning now to a consideration of the nature of the construction of the primary classifier means 30, reference will be had for this purpose particularly to FIGS. 2-7 of the drawing. As best understood with reference thereto, the primary classifier means 30 includes vane means, generally designated by reference numeral 36, and converging/diverging orifice means, generally designated by reference numeral 38. In a manner which will be more fully described hereinafter the vane means 36 is suitabley supported on the periphery of the rotatable grinding table 14 of the bowl mill 10. Moreover, the vane means 36 is operative to cause the air flowing in surrounding relation to the grinding table 14 to change direction and flow counterclockwise to the direction of rotation of the grinding table 14. This has the effect of causing the pulverized material, which may be entrained in this air, to be carried in a direction reverse to the direction of rotation of the grinding table 14 with the result that the larger of the particles of pulverized material lose their momentum, separate from the stream of air and are returned to the surface of the grinding table 14 for additional pulverization. The converging/diverging orifice means 38, on the other hand, as will be more fully described hereinafter, is suitably mounted within the interior of the bowl mill 10 in spaced relation to the surface of the grinding table 14. As a consequence of being so mounted, the converging-/diverging orifice means 38 is operative to cause the air stream, which has pulverized material entrained therein, to be directed toward the center of the interior of the bowl mill 10. This constitutes a change in the direction of flow of the air stream and is effective in causing the larger, i.e., heavier, particles of pulverized material, e.g., coal, to lose their momentum, separate out of the air stream, and be returned to the surface of the grinding table 14 for further pulverization.

Figure 2:
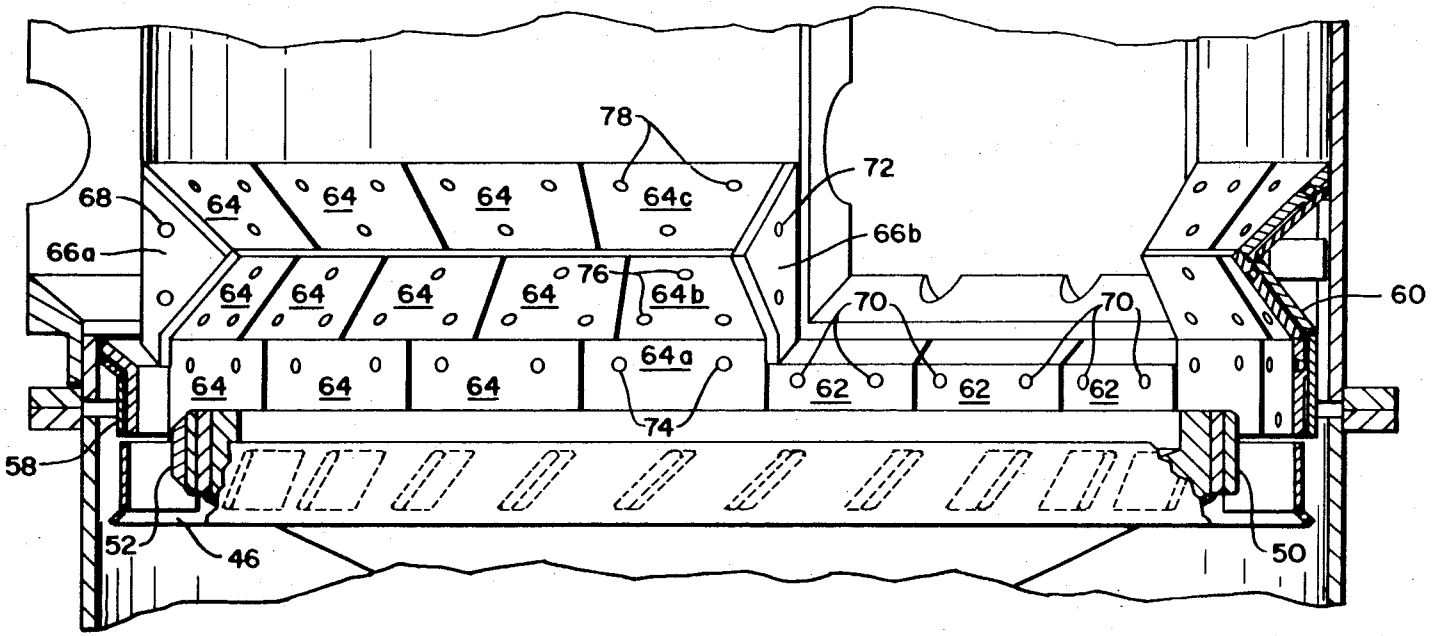
FIG. 2 is a side elevational view partially in section of a primary classifier means for bowl mills constructed in accordance with the present invention.
Figure 3:
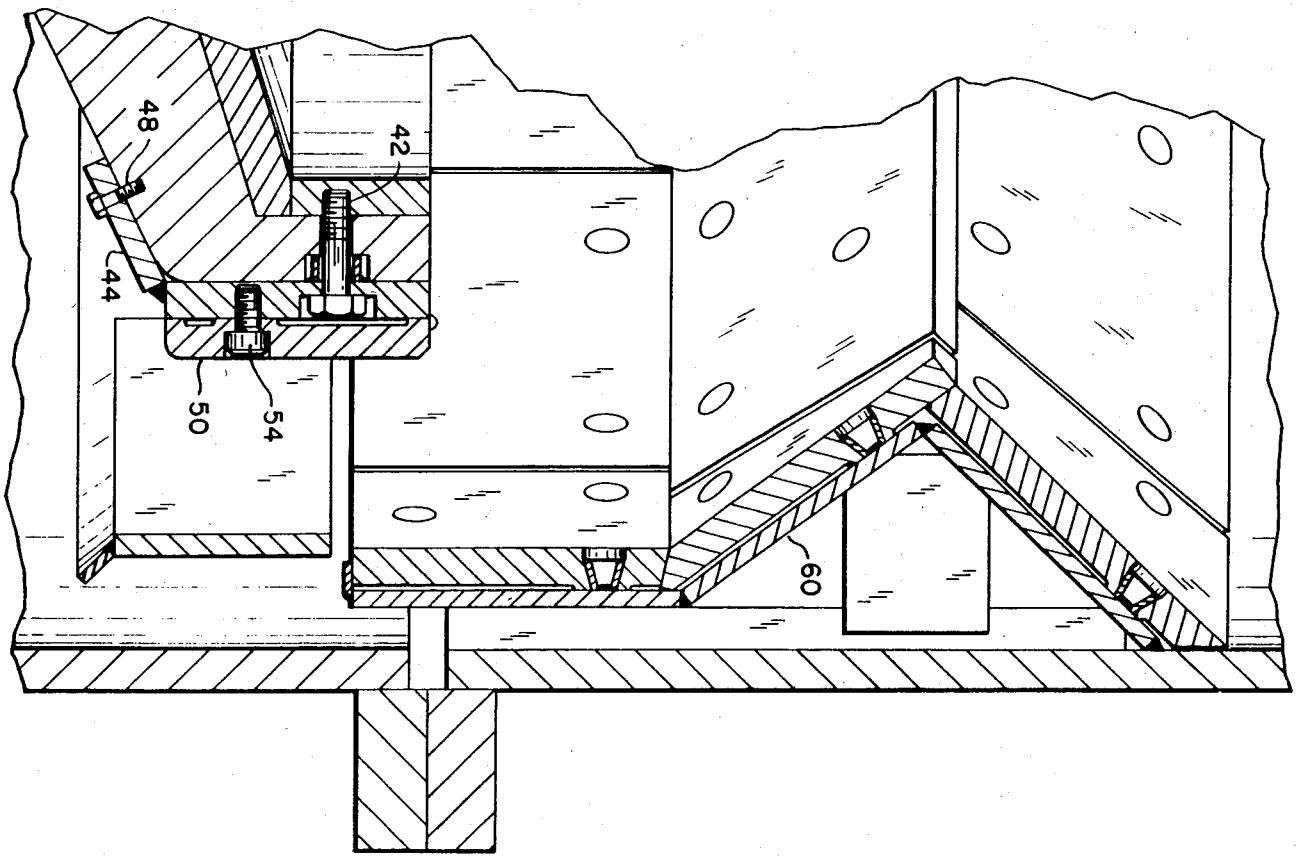
FIG. 3 is a side elevational view partially in section and on an enlarged scale of a portion of the primary classifier means for bowl mills of FIG. 2 constructed in accordance with the present invention.
Figure 7:
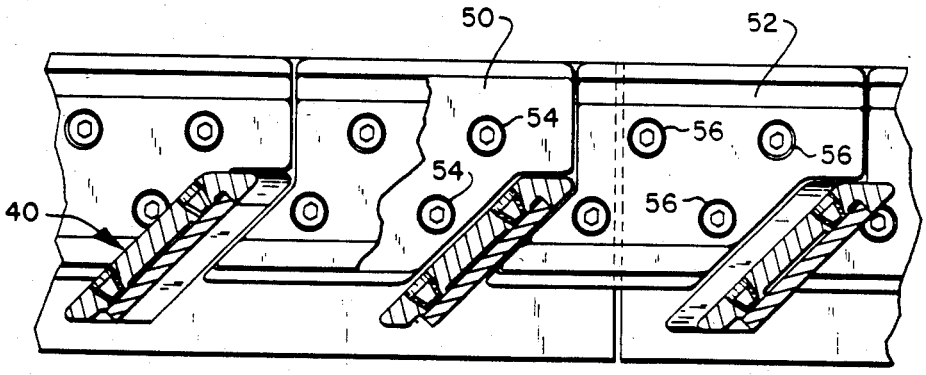
FIG. 7 is a side elevational view of a portion of the vane means of the primary classifier means constructed in accordance with the present invention.

Reference will be had first to the nature of the construction of the vane means 36, and in particular for this purpose to FIGS. 2, 3 and 7 of the drawing. To this end, the vane means 36 as best understood with reference to FIGS. 2 and 3 of the drawing includes a vane wheel segment assembly, generally designated by the reference numeral 40. The latter vane wheel segment assembly 40 is suitably affixed to the periphery, i.e., circumference, of the grinding table 14 by means of any suitable conventional form of fastening means such as through the use of threaded fasteners 42. In accord with the best mode embodiment of the invention, six such vane wheel segment assemblies 40 are provided suitably spaced one to another in mounted relation around the circumference of the grinding table 14.

Further encompassed within the vane means 36 are vane wheel supports 44 and vane wheel deflector plates 46. Moreover, insofar as the latter are concerned, preferably the number of vane wheel supports 44 and vane wheel deflector plates 46 that are utilized are equal in number to the number of vane wheel segment assemblies 40 with which the grinding table 14 is provided. More specifically, since six vane wheel segment assemblies 40 are, in accord with the best mode embodiment of the invention, employed a like number, i.e., six vane wheel supports 44 and six vane wheel deflector plates 46, are also employed.

Referring once again to FIGS. 2, 3 and 7 of the drawing, the vane wheel supports 44 are each suitably attached to a respective one of the vane wheel segment assemblies 40. Namely, the attachment of the vane wheel supports 44 to the vane wheel segment assemblies 40 is preferably accomplished through the use of any suitable conventional form of fastening means such as threaded fasteners 48. Likewise, the vane wheel deflector plates 46 are each suitably mounted through the use of any conventional form of mounting means (not shown) in supported relation to respective ones of the vane wheel segment assemblies 40. To this end, in accord with the preferred mode of construction, each vane wheel deflector plate 46 is suitably mounted so as to be equally spaced across two adjacent vane wheel segment assemblies 40. Completing the description of the vane means 36, lastly the latter includes a multiplicity of air restriction blocks, identified in FIG. 2 by way of exemplification by the reference numerals 50 and 52. More specifically, as best understood with reference to FIGS. 2, 3 and 7 of the drawing, a first set of air restriction blocks 50 are suitably mounted around the periphery, i.e., circumference of the grinding table 14 through the use of any conventional form of fastening means such as threaded fasteners 54. In accord with the best mode embodiment of the invention, preferably a total of thirty such air restriction blocks 50 are so mounted around the periphery of the grinding table 14. For those applications wherein it is deemed desirable, such as for instance because of air flow considerations, to employ additional air restriction blocks a second set of air restriction blocks is suitably mounted in superimposed relation to the air restriction blocks 50 around the circumference of the grinding table 14. The mounting of the air restriction blocks 52 in the aforesaid manner is preferably effected through the use of threaded fasteners 56. When the use of air restriction blocks 52 is deemed desirable, preferably a total of thirty air restriction blocks 52 are arranged around the periphery of the grinding table 14.

A description will now be had of the mode of operation of the vane means 36 of the primary classifier means 30 constructed in accordance with the present invention. As a prelude thereto, however, note is first made of the fact that there exists an open area, i.e., the spaced denoted by the reference numeral 32, in surrounding relation around the entire, i.e., 360°, circumference of the grinding table 14. Moreover, in the manner that has been described above, the grinding table 14 has mounted thereto a plurality of vane wheel segment assemblies 40. The latter are so attached to the circumference of the grinding table 14 such as to be rotatable therewith. Further, the vane portions of the vane wheel segment assemblies 40 project outwardly of the grinding table 14 at an angle of approximately 45° counter to the rotation of the grinding table 14. Consequently, the air exiting from beneath the grinding table 14 engages the vane wheel segment assemblies 40 and is made thereby to turn in a direction away from the direction of rotation of the grinding table 14. This change in direction of the air flow, in turn, causes any pulverized material, e.g., coal, which may be entrained in this air to be carried in a direction opposite to the direction of rotation of the grinding table 14. The effect of the latter is that the larger coal particles lose their momentum whereupon they separate from the air and are returned to the surface of the grinding table 14 for further pulverization. Finally, inasmuch as the engagement of the air having coal particles entrained therein with various surfaces of the vane means 36 is in the nature of an abrasive action the wear surfaces of the vane means 36, e.g., the vane wheel supports 44, the vane wheel deflector plates 46, the air restriction blocks 50 and 52, etc., are each preferably formed from a material noted for its good abrasive resistant qualities such as the material known as nihard to those skilled in this art.

Next a discussion will be had of the other major component of the primary classifier means 30 constructed in accordance with the present invention; namely, the converging/diverging orifice means 38. For purposes of this discussion of the converging/diverging orifice means 38 reference will be had in particular to FIGS. 2–6 of the drawing. Thus, as will be best understood with reference to FIG. 2 and as will be more fully described hereafter the converging/diverging orifice means 38 encompasses the following components: intermediate liner support plate 58, deflector liner support plate 60, intermediate liner 62, deflector liner 64 and deflector side liner 66.

Continuing with the description of the converging-/diverging orifice means 38, in accord with the best mode embodiment of the invention three such intermediate liner support plates 58 are utilized, only one thereof being visible however in FIG. 2 of the drawing. Moreover, for purposes of effecting the installation of the intermediate liner support plate 58 within the interior of the bowl mill 10, each of the intermediate liner support plates 58 is suitably centered relative to a respective one of the journal openings (not shown) with which the separator body 12 is suitably provided for purposes of accommodating therewithin the journal (not shown) that each of the pulverizer rolls 18 has cooperatively associated therewith. With the intermediate liner support plates 58 positioned in the aforesaid manner, they are preferably secured in place by means of welding, i.e., welded to the interior of the separator body 12.

Thereafter, the deflector liner support plates 60 are suitably installed within the interior of the bowl mill 10. To this end, the deflector liner support plates 60 are positioned such that they occupy the area that extends between each pair of adjoining journal openigns (not shown). Thus, inasmuch as the bowl mill 10 in accord with conventional practice is provided with three such journal openings (not shown), a like number, i.e., three such deflector liner support plates 60 are employed in the bowl mill 10. For purposes of effecting the securing of the deflector liner support plates 60 in place, the later are preferably suitably welded to the interior of the separator body 12.

After the aforesaid has been accomplished, each of the deflector liner support plates 60 has affixed thereto in a manner yet to be described one of the deflector side liners 66, i.e., that deflector side liner which is identified in FIG. 2 by means of the reference numeral **66*a*. In this regard, the deflector side liner 66*a* is suitably positioned such that preferably the back edge thereof is flush with the interior surface of the separator body 12 and such that the bottom edge thereof is arranged so as to be flush with the previously described intermediate liner support plate 58. In accord with the best mode embodiment of the invention, the securing of the deflector side liner 66*a* in place is effected through the use of welding plugs 68. Accordingly, for this purpose the deflector side liner 66*a* is provided with a plurality of openings, preferably three in number that are suitably spaced one from another which are utilized to accommodate therein the aforereferenced welding plugs 68**.

Continuing, in accord with the preferred mode of installation each of the intermediate liner support plates 58 then has a multiplicity of intermediate liners 62 mounted thereon. The particular number of intermediate liners 62 that are employed for this purpose is a function of the area that it is desired to have occupied thereby. To this end, in accord with the best mode embodiment of the invention, each of the intermediate liner support plates 58 has a total of three such intermediate liners 62 mounted thereon. However, a greater or a lesser number thereof could also be employed without departing from the essence of the invention. Further, as in the case of the aforedescribed deflector side liner 66*a*, the affixation of the intermediate liners 62 to the intermediate liner support plates 58 preferably is accomplished through the use of welding plugs 70. As such, each of the intermediate liners 62 has a number of openings formed therein that are each suitably dimensioned so as to be capable of accommodating a welding plug 70 therein. The use of welding plugs for this purpose is preferred inasmuch as it obviates the need to effect the alignment of openings in the intermediate liners 62 with corresponding openings formed in the intermediate liner support plates 58 if threaded fasteners were to be employed in lieu of welding plugs.

Thereafter, the other deflector side liner, i.e., that identified by the reference numeral 66*b* in FIG. 2, is installed in a fashion similar to that which was set forth herein previously in connection with the description of the deflector side liner 66*a*. Namely, the deflector side liner 66*b* is installed so that the back edge thereof is arranged to be flush with the separator body 12 and so that the bottom edge thereof is arranged to be flush with the intermediate liner 62. The affixation of the deflector side liner 66*b* in the aforedescribed position is preferably accomplished through the use of welding plugs 72. For this purpose the deflector side liner 66*b* is thus provided with a plurality of spaced openings each suitably dimensioned so as to be capable of accommodating therewithin a welding plug 72.

To complete the installation of the remaining components that comprise the converging/diverging orifice means 38, first the bottom row of deflector liners 64 is installed commencing with the deflector liner that is denoted in FIG. 2 by the reference numeral 64*a*. Thereafter the remainder of the bottom row of deflector liners 64 is installed moving from right to left as viewed with reference to FIG. 2 of the drawing. Each of the bottom row of deflector liners 64 which in accord with the best mode embodiment of the invention comprise twelve in number, i.e., four per each one of the deflector liner support plates 60, is secured in place preferably through the use of the welding plugs 74. To this end, each of the bottom row of deflector liners 64 is provided with a plurality of openings, e.g., three in number, the latter each being suitably dimensioned so as to be capable of accommodating one of the welding plugs 74 therewithin.

Next the middle row of deflector liners 64 is installed in mounted relation on the deflector liner support plates 60. In accord with the preferred method of installation the deflector liner identified by means of the reference numeral 64*b* in FIG. 2 is installed first. Then the remainder of the middle row of deflector liners 64 is installed moving from right to left from the deflector liner 64*b*. In accord with the best mode embodiment of the invention a total of fifteen deflector liners 64 constitute the middle row thereof with five being employed per each one of the deflector liner support plates 60. As in the case of the bottom row of deflector liners 64, each of the middle row of deflector liners 64 is secured in place by means of welding plugs 76, the latter being accommodated in corresponding openings with which each of the deflector liners 64 of the middle row are provided.

Lastly the top row of deflector liners 64 is installed beginning with the deflector liner that is identified in FIG. 2 by the reference numeral 64*c*. Thereafter, the remainder of the top row of deflector liners 64 is installed moving from right to left as viewed with reference to FIG. 2 in mounted relation on the deflector liner support plate 60. As with the middle row of deflector liners 64, preferably the top row of deflector liners 64 is comprised a total fifteen such liners, with five thereof being cooperatively associated with each one of the deflector liner support plates 60. Each of the top row of deflector liners 64 is secured in place by means of the welding plugs 78, the latter being suitably received in openings with which each one of the top row of deflector liners 64 is provided.

Figure 4:
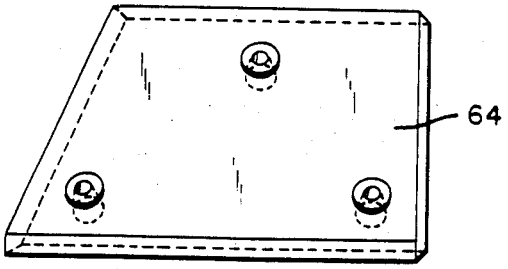
FIG. 4 is a side elevational view of a deflector liner of the converging/diverging orifice means of the primary classifier means for bowl mills constructed in accordance with the present invention.
Figure 6:
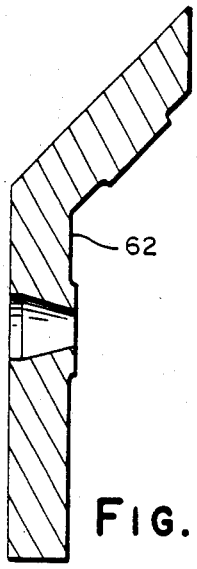
FIG. 6 is a cross-sectional view of an intermediate liner of the converging/diverging orifice means of the primary classifier means for bowl mills constructed in accordance with the present invention.
Figure 5:
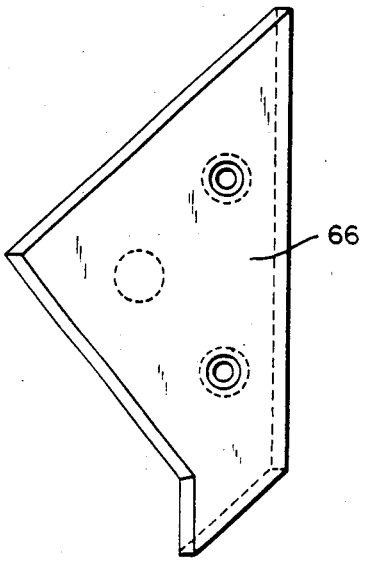
FIG. 5 is a side elevational view of a deflector side liner of the converging/diverging orifice means of the primary classifier means for bowl mills constructed in accordance with the present invention.

It is to be understood that although the bottom row, middle row and top row of deflector liners 64 have each been described herewithin as comprising a specific number of deflector liners 64, a greater or lesser number thereof could equally well be employed without departing from the essence of the present invention. One of the primary factors considered in the determination of the particular number of deflector liners 64 that is employed is that of the ease with which individual ones of the deflector liners 64 lend themselves to being handled in the course of the effectuation within the interior of the separator body 12 of their installation originally followed by their subsequent removal and replacement when they become worn. Further, as best understood with reference to FIGS. 4, 5 and 6 of the drawing the deflector liner 64, the deflector side liner 66 and the intermediate liners 62, respectively, are suitably configured so as to embody surfaces that are complementary in nature to those members that are designed to be installed in juxtaposed relation thereto. To this end, and by way of exemplification, the edge surfaces of the deflector liner 64 of FIG. 4 are suitably configured such as being beveled so as to enable them to mate with the complementary edge surfaces of the deflector liner 64 that adjoin thereto. This is not only to facilitate the initial installation of the deflector liner 64 within the separator body 12, but also to facilitate their removal and subsequent replacement when they become worn. Finally, because of the abrasive action to which they are subjected by virtue of the air having coal particles entrained therein striking thereagainst the wear surfaces of the converging/diverging orifice means 38, i.e., the deflector liners 64, the intermediate liners 62 and the deflector side liners 66 are preferably formed of a material that is noted for its good abrasive resistant qualities such as nihard.

There will now be set forth a brief description of the mode of operation of the converging/diverging orifice means 38 of the primary classifier means 30 of the bowl mill 10 constructed in accordance with the present invention. With the converging/diverging orifice means 38 mounted as has been described previously hereinabove, i.e., so as to be located above and in spaced relation to the surface of the grinding table 14, the converging/diverging orifice means 38 is operative to cause the stream of air in which the pulverized coal particles are entrained to be deflected towards the center of the interior of the bowl mill 10. This change in direction in turn causes the heavier ones of the coal particles to lose their momentum, thereby separating themselves from the air stream in which they have been entrained, and causing them to return to the surface of the grinding table 14 for regrinding, i.e., additional pulverization. The converging/diverging orifice means 38 can thus be seen to be operative to effectuate a primary classification of the coal particles which have become entrained in the air stream that flows through the interior of the bowl mill 10.

Thus, in accordance with the present invention there has been provided a new and improved primary classifier means that is suitably constructed so as to be employable in a bowl mill. Moreover, the primary classifier means for bowl mills of the present invention does not inhibit access from being had to the internal workings of the bowl mill. In addition, in accord with the present invention the primary classifier means for bowl mills includes vane means suitable supported on the circumference of the rotatable grinding surface of the bowl mill and operative to establish a direction of flow to the air that passes through the interior of the bowl mill. Further, the primary classifier means for bowl mills of the present invention also includes a converging/diverging orifice means mounted in spaced relation to the rotatable grinding surface of the bowl mill and is operative to further establish a direction of flow to the air that passes through the interior of the bowl mill. Additionally, in accordance with the present invention the primary classifier means for bowl mills has vane means and converging/diverging orifice means that function in conjunction with one another to cause the larger of the particles of pulverized material which are entrained in the stream of air that flows through the bowl mill to be separated from the air stream and to be returned to the rotatable grinding surface for additional pulverization. Also, the primary classifier for bowl mills of the present invention has the wear surfaces of the vane means and the converging/diverging orifice means formed of a highly abrasive resistant material. Furthermore, in accord with the present invention the primary classifier means for bowl mills is suitable for employment in newly constructed bowl mills as well as being equally suitable for employment in retrofit applications.

While only one embodiment of our invention has been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. In a bowl mill having a substantially closed separator body, a rotatable grinding surface having a circumference and mounted within the separator body so as to be rotatable within the separator body, at least one grinding roll mounted within the separator body so as to coact with the rotatable grinding surface, and an annular passage formed between the circumference of the rotatable grinding surface and the separator body so as to enable air to flow upwardly through the annular passage, the improvement comprising a vane wheel assembly for use within the bowl mill so as to be operative to affect the flow of air traveling within the bowl mill, said vane wheel assembly comprising:

(a) a plurality of vane wheel segments mounted to the rotatable grinding surface so as to be mounted in spaced relation one to another around the circumference of the rotatable grinding surface, each of said plurality of vane wheel segments including a vane wheel portion extending outwardly of the circumference of the rotatable grinding surface and into the annular passage at an angle of substantially 45 degrees relative to a vertical plane and in a direction counter to the direction of rotation of the rotatable grinding surface, so that air flowing through the annular passage is engaged by said vane wheel portion of each of said plurality of vane wheel segments and is caused thereby to change direction and to flow, upon exiting from the annular passage, in a direction opposite to the direction of rotation of the rotatable grinding surface;

(b) a plurality of vane wheel supports equal in number to the plurality of vane wheel segments, each of said plurality of vane wheel supports being fastened to a corresponding one of said plurality of vane wheel segments;

(c) a plurality of vane wheel deflector plates equal in number to the plurality of vane wheel segments, each of said plurality of vane wheel deflector plates being fastened to an adjoining pair of said plurality of vane wheel segments so as to be equally spaced across said adjoining pair of said plurality of vane wheel segments; and (d) an air restriction block means mounted around the circumference of the rotatable grinding surface, said air restriction block means comprising a multiplicity of air restriction blocks exceeding in number the number of said plurality of vane wheel segments, each of said air restriction blocks being mounted to the rotatable grinding surface so as to be located between said vane wheel segments.

2. In a bowl mill, the vane wheel assembly as set forth in claim 1 wherein said plurality of vane wheel segments comprises six in number.

3. In a bowl mill, the vane wheel assembly as set forth in claim 2 wherein said air restriction block means includes a first set of air restriction blocks mounted around the circumference of the rotatable grinding surface and a second set of air restriction blocks mounted in superimposed relation on said first set of air restriction blocks.

4. In a bowl mill, the vane wheel assembly as set forth in claim 3 wherein said first set of air restriction blocks and said second set of air restriction blocks each consists of thirty air restriction blocks.

5. In a bowl mill, the vane wheel assembly as set forth in claim 4 wherein at least a portion of each of said plurality of vane wheel segments, said plurality of vane wheel supports, said plurality of vane wheel deflector plates, said first set of air restriction blocks and said second set of air restriction blocks is formed of a material having good abrasive resistant qualitites.

* * * * *